US005918494A

United States Patent [19]

Kojima et al.

[11] Patent Number: 5,918,494

[45] Date of Patent: Jul. 6, 1999

[54] METHOD AND APPARATUS FOR HYDROFORMING METALLIC TUBE

[75] Inventors: Masayasu Kojima, Takarazuka; Saburo Inoue, Tama, both of Japan

[73] Assignee: Sumitomo Metal Industries, Ltd., Osaka, Japan

[21] Appl. No.: 09/063,827

[22] Filed: Apr. 22, 1998

[30] Foreign Application Priority Data

Apr. 25, 1997 [JP] Japan ..... 9-108519

[51] Int. Cl.[6] ..... B21D 26/02

[52] U.S. Cl. ..... 72/58; 72/62

[58] Field of Search ..... 72/58, 62, 56

[56] References Cited

U.S. PATENT DOCUMENTS

| | | | |
|---|---|---|---|
| 2,631,640 | 3/1953 | Zallea | 72/58 |
| 3,335,590 | 8/1967 | Early | 72/58 |
| 3,974,675 | 8/1976 | Tominaga | 72/56 |
| 4,317,348 | 3/1982 | Halene et al. | 72/62 |
| 4,748,836 | 6/1988 | Hoeboer et al. | 72/58 |
| 5,214,948 | 6/1993 | Sanders et al. | 72/58 |
| 5,388,440 | 2/1995 | Folmer | 72/62 |

FOREIGN PATENT DOCUMENTS

| | | |
|---|---|---|
| 1120409 | 12/1961 | Denmark . |
| 56-154228 | 11/1981 | Japan . |
| 58-187220 | 1/1983 | Japan . |
| 61-235025 | 10/1986 | Japan . |
| 1417954 | 8/1988 | U.S.S.R. . |

*Primary Examiner*—David Jones

*Attorney, Agent, or Firm*—Armstrong, Westerman, Hattori, McLeland & Naughton

[57] ABSTRACT

A method and apparatus for hydroforming a metallic tube including the steps of: preliminarily expanding the metallic tube over an axial section longer than the length of the expanded portion of a final product as measured in the axial direction of the metallic tube; and compressing the preliminarily expanded portion in the axial direction of the metallic tube so as to form the shape of the expanded portion of the final product. According to the method and apparatus of the invention, frictional resistance between the metallic tube and processing tools can be reduced, and moreover, the internal pressure within the metallic tube can be reduced during expansion processing. Furthermore, the cost for the manufacture of metallic die is reduced, and in addition, yield is improved

4 Claims, 9 Drawing Sheets

METHOD AND APPARATUS FOR HYDROFORMING METALLIC TUBE

BACKGROUND OF THE INVENTION

1. Field of the Invention

The present invention relates to a method and apparatus for hydroforming a metallic tube in a which the metallic tube is formed in a closed die cavity using pressurized fluid introduced into the metallic tube.

2. Description of the Related Art

Metallic-tube hydroforming comprises the steps of introducing a hydraulic fluid into a metallic tube serving as a material tube (hereinafter, referred to merely as a metallic tube) and applying an axial force to the tube ends, to thereby form the metallic tube through combined use of hydraulic pressure and the axial forces. The process provides tubular parts having a variety of cross-sectional shapes. FIG. 5 shows a metallic tube and a product, wherein FIG. 5(*a*) shows a longitudinal sectional view of a metallic tube 1 and FIG. 5(*b*) shows a partially sectional view of a product 2 obtained through hydroforming.

In the product of FIG. 5(*b*), radially expanded portion 2*a* having an outer diameter D and a length $W_1$ is formed in the central section of the product, and tubular portions having the same outer diameter d as that of the metallic tube 1 of FIG. 5(*a*) (hereinafter referred to as straight portions) extend lengthwise from the expanded portion 2*a*. The overall length $L_1$ of the product 2 becomes shorter than the length $L_0$ of the metallic tube 1 because of axial pressing.

FIG. 6 shows a typical tooling used in a conventional hydroforming apparatus for obtaining the product 2, wherein FIG. 6(*a*) is a longitudinal sectional view and FIG. 6(*b*) is a sectional view taken along the line C—C in FIG. 6(*a*).

A tool 15 includes a die composed of a lower die 3 and an upper die 4 and left and right punches 5 and 6. The lower die 3 and the upper die 4 have tube-holding grooves 3*a* and 4*a* and die cavities 3*b* and 4*b* formed therein, respectively. The diameter d of the tube-holding grooves 3*a* and 4*a* is identical to the outer diameter of the metallic tube 1 The die cavities 3*b* and 4*b* define a space for forming the expanded portion of a product. The internal contour of the die cavities 3*b* and 4*b* is identical to the external contour of the expanded portion of a products. Die shoulders 3*c* and 4*c* have a radius of curvature equal to a forming corner radius r1 of the product shown in FIG. 5(*b*). An ejector 17 is mounted in a vertically slidable manner in the lower die 3 at the bottom of the die cavity 3*b* for the purpose of ejecting a formed product. The punches 5 and 6 have substantially the same diameter as the outer diameter d of a metallic tube and are provided with flanges 5C and 6C, respectively, at their outer ends for connection to axial pistons, which will be described later. The punch 5 has a through path 5*b* formed therein for introducing a hydraulic fluid, which will be described later, into a metallic tube, and the punch 6 has a through path 6*b* formed therein for ejecting air from the interior of the metallic tube.

FIG. 7 shows a process for hydroforming a metallic tube by applying an internal pressure and axial forces to the metallic tube through use of the tool 15, wherein FIG. 7(*a*) is a longitudinal sectional view showing a state immediately before hydroforming is started and FIG. 7(*b*) is a longitudinal sectional view showing a state when hydroforming is completed.

First, the metallic tube 1 is set in the lower die 3. The upper die 4, attached to a vertical press unit which will be described later, is lowered so as to press the lower die 3 with a predetermined force. Next, the punches 5 and 6, attached to respective horizontal press units which will be described later, are advanced from the left- and right-hand sides such that their top end portions 5*a* and 6*a* seal the corresponding ends of the metallic tube 1. While a hydraulic fluid 7 is being introduced into the metallic tube 1 through the path 5*b* in the left-hand punch 5, air inside the metallic tube 1 is ejected through the path 6*b* in the right-hand punch 6. Then, an unillustrated valve located on the extension of the path 6*b* is closed to thereby fill the interior of the metallic tube 1 with the hydraulic fluid 7. This state is shown in FIG. 7(*a*).

Next, the punches 5 and 6 are advanced from the left- and right-hand sides, and the internal pressure of the metallic tube 1 is gradually increased by means of an unillustrated pump. Thus, the material of the metallic tube 1 is expanded into the die cavities 3*b* and 4*b* to thereby form a product 2 as shown in FIG. 7(*b*). The internal pressure of the metallic tube 1 is gradually increased so as to expand the tube material which work-hardens gradually as it is pressed into the die cavities 3*b* and 4*b* through axial pressing. When the tube material has a high strength and a large wall thickness or when the forming corner radius of an expanded portion is small, a required internal pressure is high. Subsequently, the internal pressure is reduced, the upper die 4 is raised, the punches are retreated to drain the hydraulic fluid from inside the product 2, and the ejector 17 is raised to remove the product 2 from the lower die 3.

An example of the hydraulic fluid 7 is an emulsion in which a fat-and-oil component is uniformly dispersed in water in an amount of several percent so as to produce a rust-preventive effect.

Next will be described a conventional apparatus for performing the above hydroforming process.

FIG. 8 shows a conventional hydroforming apparatus, wherein FIG. 8(*a*) shows a front view of the apparatus and FIG. 8(*b*) shows a sectional view of a horizontal press unit.

As shown in FIG. 8(*a*), the hydroforming apparatus includes a vertical press unit 21 and horizontal press units 22 and 23. These press units share a bed 24. The vertical press unit 21 includes a frame 26 connected to the bed 24 by means of columns 25, a pressure cylinder 27 attached to the frame 26, a ram 28 of the cylinder 27, and a ram head 29 attached to the ram 28. The lower die 3 is removably mounted on the bed 24, and the upper die 4 is removably mounted on the ram head 29. A cylinder 19 is provided just under the lower die 3 in order to vertically move the ejector 17.

As shown in FIG. 8(*b*), the horizontal press unit 22 includes a cylinder case 30 and a piston 31. The punch 5 is removably attached to the tip portion 31*d* of the piston 31 through bolting or the like. The piston 31 has a hydraulic fluid path 31C formed therein and communicating with the path 5*b* formed in the punch 5. The hydraulic fluid path 31C communicates with an unillustrated external pump via a hollow beam 33 connected to the rear end of the piston 31 and via a piping 32. The piston 31 moves axially within the cylinder case 30 under the guidance established between the outer surface 31*a* of the piston 31 and a cylinder flange 30*b*, between a piston flange 31*b* and the shell 30*a* of the cylinder case 30, and between the hollow beam 33 and the rear plate 30*c* of the cylinder case 30.

Seals 40, 41, and 42 are provided in the above guide portions. When a hydraulic fluid having a predetermined pressure is fed into a rear pressure chamber 50 from an unillustrated external pump via a path 51 formed in the cylinder case 30 and a piping 52, the piston 31 advances. In contrast, when a hydraulic fluid having a predetermined pressure is fed into a front pressure chamber 60 from an unillustrated external pump via a path 61 formed in the cylinder case 30 and a piping 62, the piston 31 retreats.

The above hydroforming process involves the following problems.

A first problem relates to axial pressing. As mentioned previously, axial pressing and an internal pressure play an important role in hydroforming. Particularly, for a product which involves a large increase in circumferential length caused by expansion forming, an axial pressing plays a particularly important role. When an internal pressure is increased while axial pressing is insufficient, the wall thickness of a portion to be expanded decreases progressively, resulting in the rupture of the portion. In order to suppress a reduction of wall thickness, a tube material must be pressed into a die cavity by axial pressing before an internal pressure is increased, so as to form a raised portion having a double curved surface to thereby increase resistance to rupture.

In the hydroforming process described above with reference to FIG. 7(*a*), factors adverse to axial pressing are the following two: friction between a tube material and the tube-holding grooves 3*a* and 4*a*; and friction between the die shoulders 3*c* and 4*c* and a tube material sliding along the radii of the die shoulders 3*c* and 4*c*, and a bending deformation of a tube material sliding along the radii of the die shoulders 3*c* and 4*c*. The former factor relates to a coefficient of friction and the length l of a tube material in contact with the tube-holding grooves 3*a* and 4*a*. The latter factor relates to a coefficient of friction and the radius r1 of the die shoulders 3*c* and 4*c* (as the radius r1 decreases, resistance to axial pressing increases) if the strength of a tube material is not taken into consideration. In order to reduce a coefficient of friction, a hydroforming die is manufactured of a hard material so that the die becomes endurable to damage upon sliding contact with a tube material, and tube-holding grooves and die shoulders are finished smoothly. Also, to maintain the smoothly finished condition, the die surface must be polished regularly.

Further, in order to prevent seizure between a tube material and the die, in many cases the outer surface of the metallic tube 1 is coated with a lubricant or paint. However, even when such measures are employed, if the length l of a tube material in contact with the tube-holding grooves 3*a* and 4*a* (see FIG. 7(*a*)) is relatively large, the contact area between the tube material and the tube-holding grooves 3*a* and 4*a* become relatively large. Consequently, there becomes relatively large a frictional resistance associated with the movement of the entire tube material within the tube-holding grooves 3*a* and 4*a*.

FIG. 9 is a longitudinal sectional view showing the occurrence of a defect during hydroforming, wherein FIG. 9(*a*) shows the occurrence of buckling and FIG. 9(*b*) shows the occurrence of wall thickening at tube end portions.

In the case of a thin-walled tube, buckling as represented by reference numeral 8 in FIG. 9(*a*) is likely to occur at the straight portions during axial pressing. Accordingly, in the case of a thin-walled carbon steel tube, axial pressing becomes hard to perform at a l/d value of 2.0 or more for t/d=0.03 (t: wall thickness) and at a l/d value of 1.5 or more for t/d=0.02.

In the case of a thick-walled tube, buckling is less likely to occur. However, resistance to axial pressing increases due to an increase in resistance to bending along the radii of the die shoulders 3*c* and 4*c*. Consequently, as shown in FIG. 9(*b*), a thick-walled portion 9 thicker than the wall thickness of the metallic tube 1 is formed at tube end portions, thus hindering expansion. Accordingly, in order to form the expanded portion 2*a* having a predetermined shape, the overall amount of axial pressing (that is, the length of the metallic tube 1) must unavoidably be increased with a resultant deterioration in material yield. Also, in addition to an increase in product weight, the thick-walled portions 9 may need to be machined after hydroforming in order for the finish wall thickness to meet a predetermined value.

A second problem relates to the die manufacturing cost. The lengths (along the axial direction of the metallic tube 1) of the lower and upper dies 3 and 4, respectively, must be increased. That is, as shown in FIG. 7, the lower and upper dies 3 and 4, respectively, must have a length equivalent to the overall length of the metallic tube 1 plus the length of the tip portions of the punches 5 and 6 to be inserted into the lower and upper dies 3 and 4. As mentioned previously, in many cases the die is manufactured of a hard material in order to prevent seizure between a tube material and the die. Accordingly, an increase in die length causes an increase in material cost as well as an increase in man-hours for machining the tube-holding grooves 3*a* and 4*a*. Also, the die cavities 3*b* and 4*b* must be machined by an end mill in the lower and upper dies 3 and 4, respectively, according to the shape of the expanded portion 2*a* of a product, and the surfaces of the die cavities 3*b* and 4*b* must be finished smoothly. Thus, machining cost increases. Some shapes may be hard to machine and must unavoidably be formed through use of expensive electric discharge machining. Further, when products having expanded portions of different sizes are to be manufactured, dies having corresponding die cavities of different sizes must be prepared.

Further, since the die cavities 3*b* and 4*b* must have a shape enabling a product to be ejected therefrom, the shape of a certain expanded portion of a product may be hardly formed merely through use of the die cavities 3*b* and 4*b*.

FIG. 10 exemplifies a product having such a rather complex shaped expanded portion, wherein FIG. 10(*a*) is a longitudinal sectional view of a product 70 and FIG. 10(*b*) is a front view of the product 70. Indentations 70*c* are formed in the side walls of the expanded portion 70*a* of the product 70. Accordingly, if the internal contour of the die cavity is identical to the external contour of the expanded portion 70*a*, the formed product 70 cannot be ejected.

FIG. 11 is a longitudinal sectional view showing the structure of a die for manufacturing the product 70 of FIG. 10. As seen from FIG. 11, the product 70 is manufactured in the steps of: forming an expanded portion not having the indentations 70*c*; projecting punches 72 by means of pressure cylinders 71 built in lower and upper dies 3-1 and 4-1, respectively, so as to form the indentations 70*c*; retreating the punches 72; and removing the product 70 from the die. Thus, the die structure becomes complex, and manufacturing cost increases accordingly.

SUMMARY OF THE INVENTION

An object of the present invention is to provide a method and apparatus for hydroforming a metallic tube capable of solving the above first problem relating to axial pressing and the above second problem relating to die manufacturing cost.

To achieve the above object, the present invention provides (1) A method for hydroforming a metallic tube in which part of the metallic tube is expanded through combined use of an internal pressure imposed by a fluid contained in the metallic tube and an axial compression of the metallic tube, comprising the steps of: preliminarily expanding the metallic tube over an axial section longer than the length of the expanded portion of a final product as measured in the axial direction of the metallic tube; and compressing the preliminarily expanded portion in the axial direction of the metallic tube so as to form the shape of the expanded portion of the final product.

(2) An apparatus for hydroforming a metallic tube, comprising: a split-type punch holder having a through hole; a pair of hollow cylindrical outer punches inserted slidably into the through hole from both ends of the through hole; and a pair of inner punches inserted slidably into the corresponding outer punches so as to axially compress the metallic tube inserted into the outer punches from both ends of the metallic tube; wherein a hydraulic fluid path is formed in the inner punches and wherein a pair of punch advancing-retreating means is provided for advancing or retreating the inner punch and the outer punch independently of each other in the axial direction of the metallic tube.

(3) The apparatus for hydroforming a metallic tube as discribed above in (2), wherein the punch advancing-retreating means comprises an inner piston for advancing or retreating the inner punch in the axial direction of the metallic tube and a cylindrical outer piston for advancing or retreating the outer punch in the axial direction of the metallic tube, the inner piston is placed within the cylindrical outer piston, and a hydraulic fluid path is formed in the inner piston in a manner connectable to the hydraulic fluid path formed in the inner punch.

(4) A tubular part having an expanded portion, manufactured from a metallic tube by the steps of: preliminarily expanding the metallic tube over an axial section longer than the length of the expanded portion of a final tubular part as measured in the axial direction of the metallic tube; and compressing the preliminarily expanded portion in the axial direction of the metallic tube so as to form the shape of the expanded portion of the final tubular part.

The inventors of the present invention conducted experiments and studies in an attempt to: 1) prevent an impairment in material yield, through reduction in frictional resistance between a metallic tube and a tool, which impairment would otherwise result due to buckling during axial pressing or, in the case of a thick-walled tube, due to wall thickening at tube ends; 2) enable a metallic tube to have a thinner wall thickness by reducing the internal pressure of a metallic tube so as to retard wall thinning at an expanded portion; and 3) reduce die manufacturing cost. As a result, the inventors obtained the below findings and achieved the invention a) By following the steps of preliminarily radially expanding a metallic tube over an axial section longer than the length of the expanded portion of a final product as measured in the axial direction of the metallic tube and compressing the preliminarily radially expanded portion in the axial direction of the metallic tube so as to form the shape of the expanded portion of the final product, the internal pressure of the metallic tube can be maintained at relatively low levels during forming; thus, wall thinning at the expanded portion can be prevented b) Such forming can be performed without using a conventional die having a die cavity formed therein for forming an expanded portion, but through use of an apparatus comprising a punch holder having a through hole formed therein and serving as a die equivalent, a pair of hollow cylindrical outer punches inserted slidably into the through hole from both ends of the through hole, and a pair of inner punches inserted slidably into the corresponding outer punches so as to axially compress a metallic tube inserted into the outer punches from both ends of the metallic tube. An expanded portion is formed between the tip ends of the outer punches.

DETAILED DESCRIPTION OF THE INVENTION

Figure 1B:
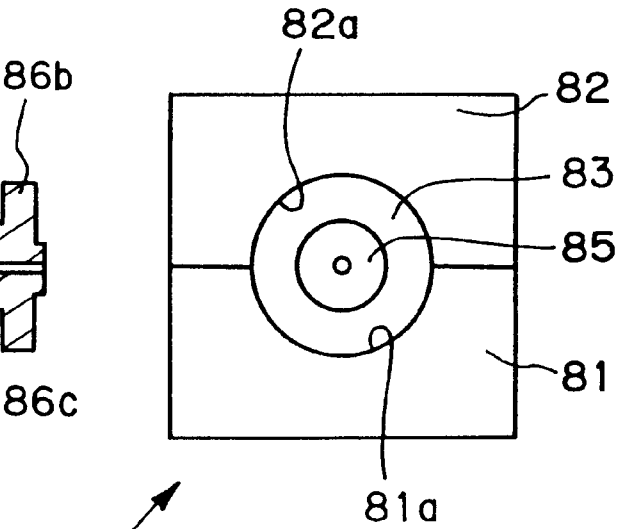
FIG. 1 is a view showing a hydroforming apparatus of the present invention (punch advancing-retreating means are not illustrated), wherein FIG. 1(*a*) is a longitudinal sectional view and FIG. 1(*b*) is a sectional view taken along the line C—C in FIG. 1(*a*)
Figure 1A:
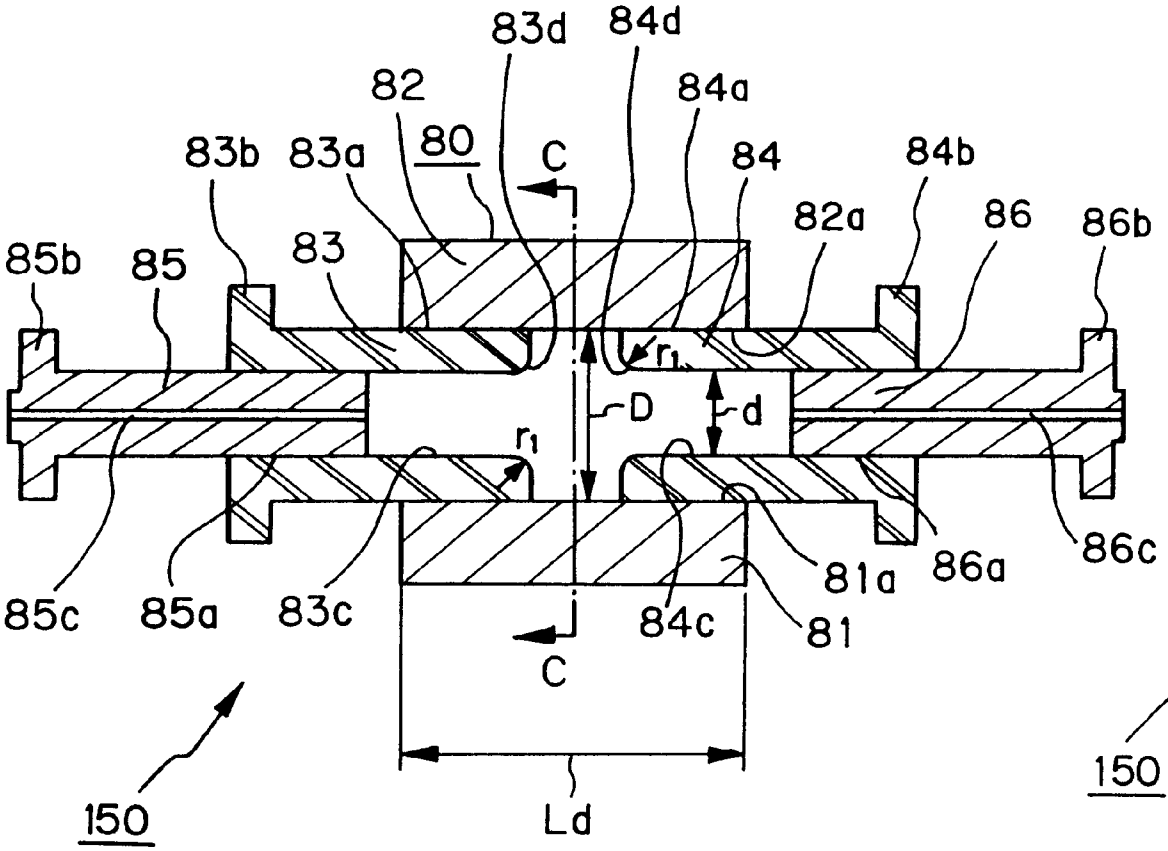
Figure 5A:
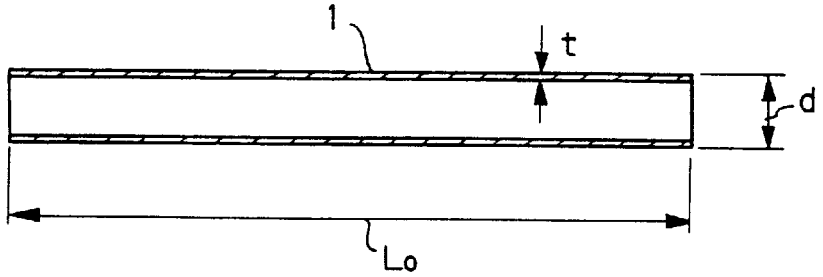
FIG. 5 is a view showing a metallic tube and a product, wherein FIG. 5(*a*) is a longitudinal sectional view of the metallic tube 1 and FIG. 5(*b*) is a partially sectional view showing a hydroformed product.
Figure 5B:
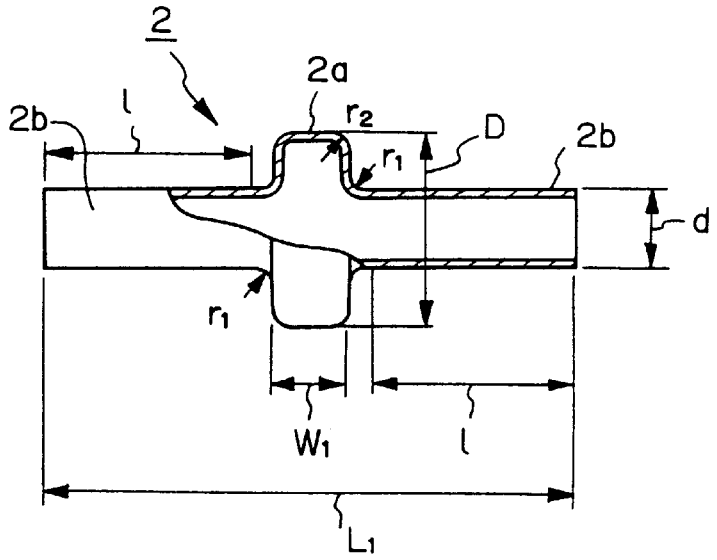

FIG. 1 is a view showing a hydroforming apparatus of the present invention (punch advancing-retreating means are not illustrated), wherein FIG. 1(*a*) is a longitudinal sectional view and FIG. 1(*b*) is a sectional view taken along the line C—C in FIG. 1(*a*). The hydroforming apparatus can form a metallic tube as shown in FIG. 5(*a*) into a tubular part as shown in FIG. 5(*b*).

In FIG. 1, a hydroforming apparatus 150 includes a punch holder 80 composed of a lower holder 81 and an upper holder 82, inner punches 85 and 86, outer punches 83 and 84, and unillustrated punch advancing-retreating means, which will be described later. Guide grooves 81*a* and 82*a* formed in the lower and upper holders 81 and 82, respectively, define a through hole formed in the holder 80. The hollow cylindrical outer punches 83 and 84 are inserted slidably into the guide grooves 81*a* and 82*a*.

The guide grooves 81*a* and 82*a* have a cross section identical to that of the expanded portion of a product. The shape of the cross section of the guide grooves 81*a* and 82*a* is constant in the longitudinal direction of the punch holder 80 and can be readily machined. The inner tip shoulders 83*d* and 84*d* of the outer punches 83 and 84, respectively, are machined to a radius identical to the root forming corner radius r (see FIG. 5(*b*)) of the expanded portion 2*a* of a product. The rear end portions of the outer punches 83 and 84 are provided with flanges 83*b* and 84*b*, respectively, for engagement with corresponding horizontal press units, which will be described later.

The inner punches 85 and 86 are inserted slidably into the internal contour portions 83*c* and 84*c* of the outer punches 83 and 84, respectively. The crosssectional shape of the internal contour portions 83*c* and 84*c* corresponds to that of the inner punches 85 and 86 and is substantially identical to that of a metallic tube 1.

The inner punches 85 and 86 have hydraulic fluid paths 85*c* and 86*c*, respectively, formed therein and flanges 85*b* and 86*b*, respectively, for engagement with corresponding double acting horizontal press units, which will be described later.

Figure 2A:
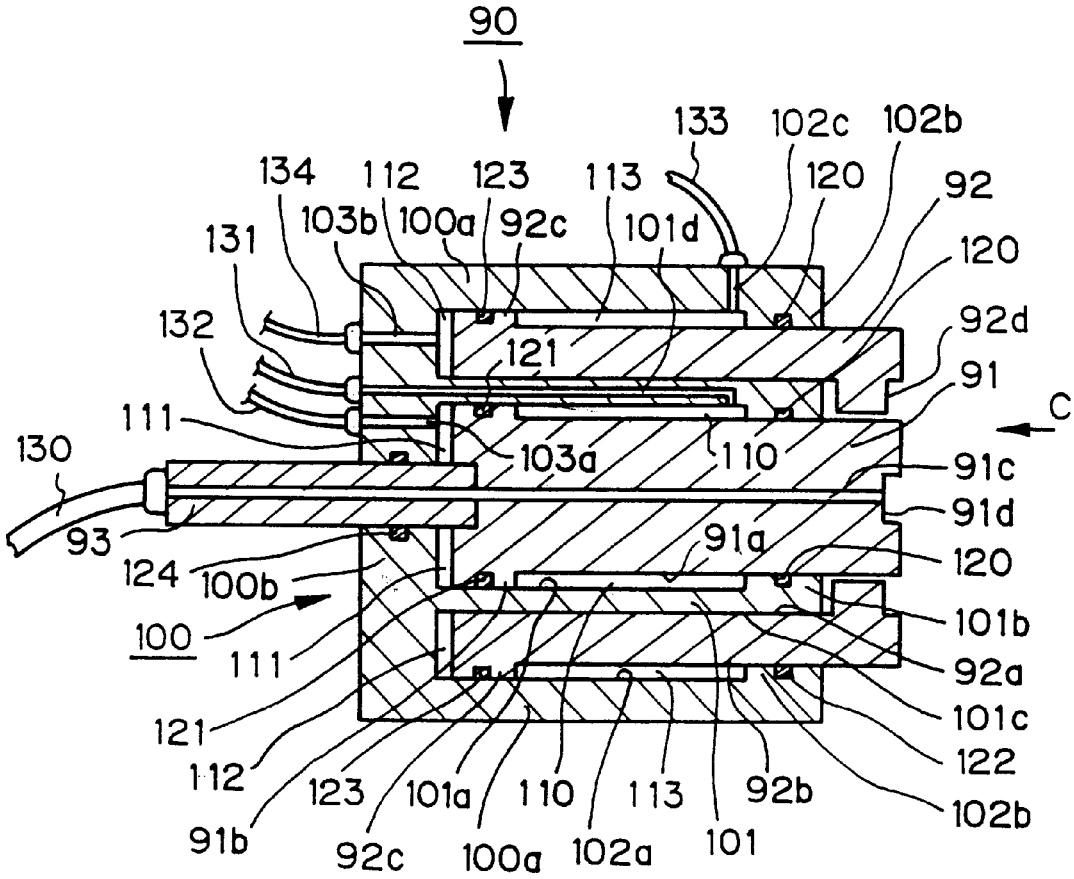
FIG. 2 is a view showing a double acting horizontal press unit, wherein FIG. 2(*a*) is a longitudinal sectional view and FIG. 2(*b*) is a front view as viewed from the direction of the arrow C in FIG. 2(*a*)
Figure 2B:
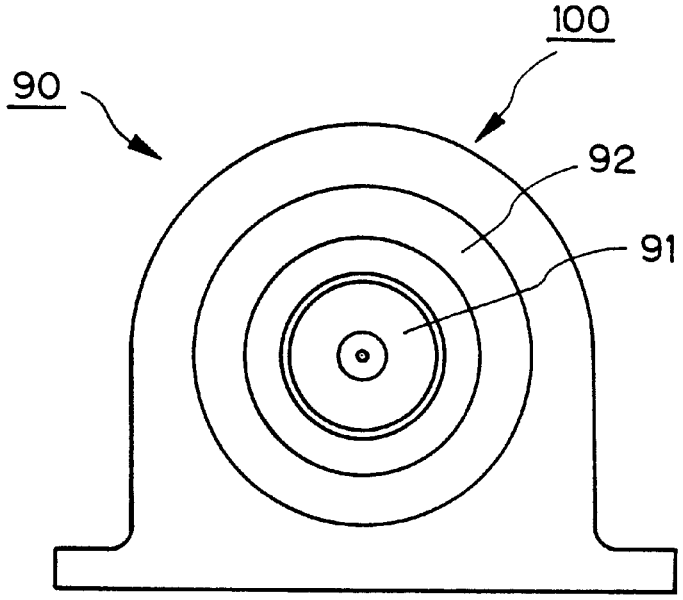
Figure 3A:
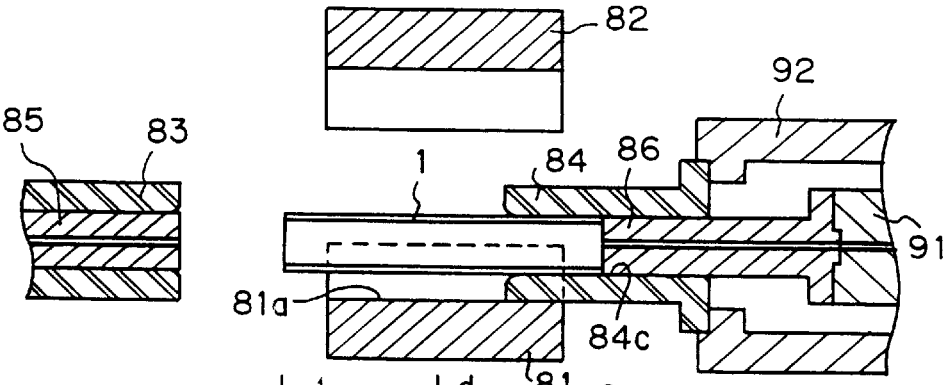
FIG. 3 is a partial view of the hydroforming apparatus for explaining the hydroforming process of the present invention, wherein FIG. 3(*a*) is a view showing a state in which a metallic tube is set in the hydroforming apparatus, FIG. 3(*b*) is a view showing a state before the metallic tube is preliminarily expanded, FIG. 3(*c*) is a view showing a state after the metallic tube is preliminarily expanded, and FIG. 3(*d*) is a state after the finish-processing is completed.
Figure 3B:
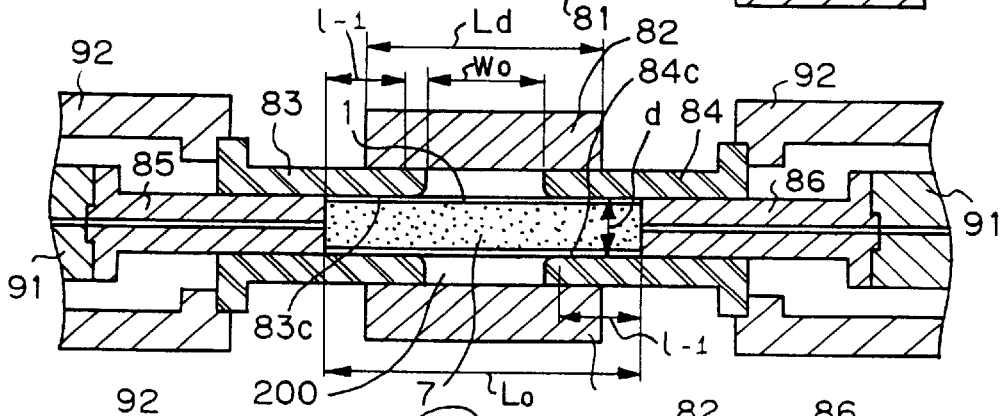
Figure 3C:
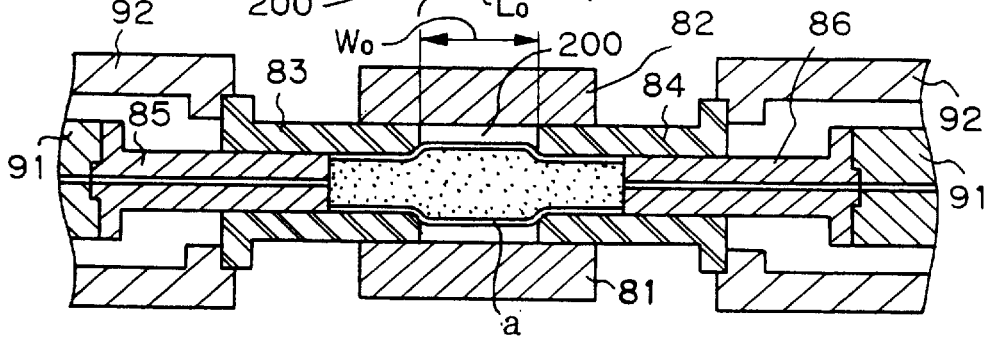
Figure 3D:
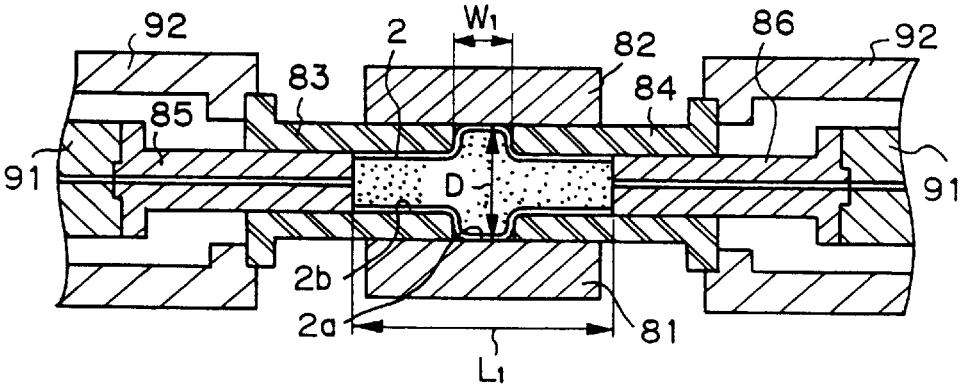

FIG. 2 shows an example of a double acting horizontal press unit, wherein FIG. 2(*a*) is a longitudinal sectional view and FIG. 2(*b*) is a front view as viewed from the direction of the arrow C in FIG. 2(*a*) A double acting horizontal press unit 90 is adapted to axially advance or retreat the left-hand inner punch 85 and outer punch 83 in FIG. 1 The right-hand inner punch 86 and outer punch 84 in FIG. 1 are also attached to another double acting horizontal press unit having the same structure as that of the press unit 90.

The double acting horizontal press unit 90 includes a cylinder case 100, an inner piston 91, and a cylindrical outer piston 92 located along the periphery of the inner piston 91. The inner punch 85 is removably attached to the tip portion 91*d* of the inner piston 91 through bolting or the like, and the outer punch 83 is removably attached to the tip portion 92*d* of the outer piston 92 through bolting or the like. A hydraulic fluid path 91*c*, which communicates with the hydraulic fluid path 85*c* formed in the inner punch 85, is formed in the inner piston 91 and connected to an unillustrated external hydraulic fluid pump by means of a piping 130 via a hollow beam 93 connected to the rear end of the inner piston 91.

Since the outer piston assumes a cylindrical shape so as to accommodate the inner piston, the horizontal press unit becomes significantly compact.

The cylinder case 100 has a dual structure in which an outer shell 100*a* and an inner shell 101 are placed while a certain gap is present between them, and are integrated via a common rear plate 100*b*. The inner piston 91 is inserted into the inner shell 101. The outer surface 91*a* of the inner piston 91 is guided by the flange 101*b* of the inner shell 101 via a seal 120, and the flange 91*b* of the inner piston 91 is guided by the inner surface 101*a* of the inner shell 101 via a seal 121, thereby forming a pressure fluid chamber 110.

The pressure fluid chamber 110 is connected to an unillustrated external hydraulic fluid pump by means of a piping 131, via a hydraulic fluid path 101*d*, formed in the inner shell 101 of the cylinder case 100.

The hollow beam 93 is guided by the rear plate 100*b* of the cylinder case 100 via a seal 124. A pressure fluid chamber 111 is formed between the inner piston 91 and the rear plate 100*b*. The pressure fluid chamber 111 is connected to an unillustrated external hydraulic fluid pump by means of a piping 132, via a hydraulic fluid path 103*a*, formed in a penetrating manner in the rear plate 100*b*. The inner piston 91 advances or retreats depending on which axial force is larger, an axial force induced by the pressure of a hydraulic fluid contained in the pressure fluid chamber 110 or an axial force induced by the pressure of a hydraulic fluid contained in the pressure fluid chamber 111.

The cylindrical outer piston 92 is inserted between the inner shell 101 of the cylinder case 100 and the outer shell 100*a* of the cylinder case 100. The inner surface 92*a* of the outer piston 92 is guided by the outer surface 100*c* of the inner shell 101. The outer surface 92*b* of the outer piston 92 is guided by the flange 102*b* of the outer shell 100*a* via a seal 122, and the flange 92*c* of the outer piston 92 is guided by the inner surface 102*a* of the outer shell 100*a* via a seal 123, thereby forming a pressure fluid chamber 113. The pressure fluid chamber 113 is connected to an unillustrated external hydraulic fluid pump by means of a piping 133 via a hydraulic fluid path 102*c* formed in a penetrating manner in the outer shell 100*a*. A pressure fluid chamber 112 is formed between the cylindrical outer piston 92 and the rear plate 100*b* of the cylinder case 100.

The pressure fluid chamber 112 is connected to an unillustrated external hydraulic fluid pump by means of a piping 134, via a hydraulic fluid path 103*b*, formed in a penetrating manner in the rear plate 100*b* of the cylinder case 100. The cylindrical outer piston 92 advances or retreats depending on which axial force is larger, an axial force induced by the pressure of a hydraulic fluid contained in the pressure fluid chamber 112 or an axial force induced by the pressure of a hydraulic fluid contained in the pressure fluid chamber 113.

There are provided separate external hydraulic fluid pumps for advancing or retreating the inner and outer pistons, so that the inner and outer pistons can move independent of each other. Of course, the inner and outer pistons can be moved simultaneously The double acting horizontal press unit shown in FIG. 2 is a mere example. The double acting horizontal press unit may have another structure so long as it provides the inner and outer punches and can axially advance or retreat them independent of each other.

A hydroforming method according to the present invention is described below.

Figure 4:
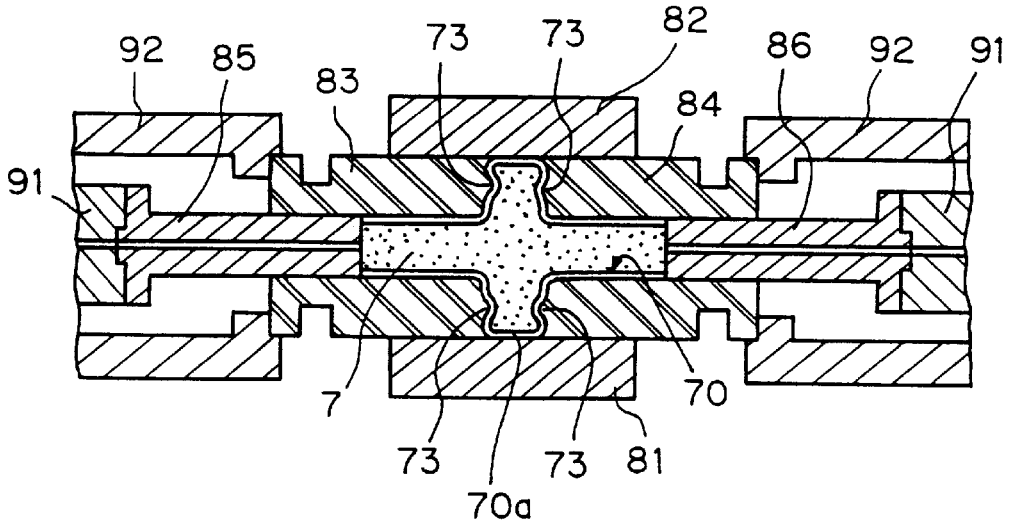
FIG. 4 is a view showing application of the present invention to the manufacture of a product whose expanded portion has indentations formed in its side walls.

FIG. 3 is a partial view of a hydroforming apparatus for explaining the hydroforming process of the present invention, wherein FIG. 3(*a*) is a view showing a state in which a metallic tube is set in the hydroforming apparatus, FIG. 3(*b*) is a view showing a state before the metallic tube is preliminarily expanded, FIG. 3(*c*) is a view showing a state after the metallic tube has been preliminarily expanded, and FIG. 4(*d*) is a state after the finish-processing is completed.

As shown in FIG. 3(*a*), the metallic tube 1 is inserted into the internal contour portion 84*c* of the outer punch 84, which is guided by the guide groove 81*a* formed in the lower holder 81, and positioned by the inner punch 86. Next, as shown in FIG. 3(*b*), the left-hand outer punch 83 is advanced so as to form, together with the right-hand outer punch 84, a die cavity 200 having a length $W_0$ longer than a length $W_1$ of the expanded portion of a product. Further, the left-hand inner punch 85 is advanced such that the inner punches 85 and 86 closely contact and seal both end surfaces of the metallic tube 1 The upper holder 82 is lowered to press the outer punches 83 and 84 against the lower holder 81. The hydraulic fluid 7 is fed into the metallic tube 1. Thus, a preliminary expansion process becomes ready to perform The length $W_0$ will be described later.

Figure 7A:
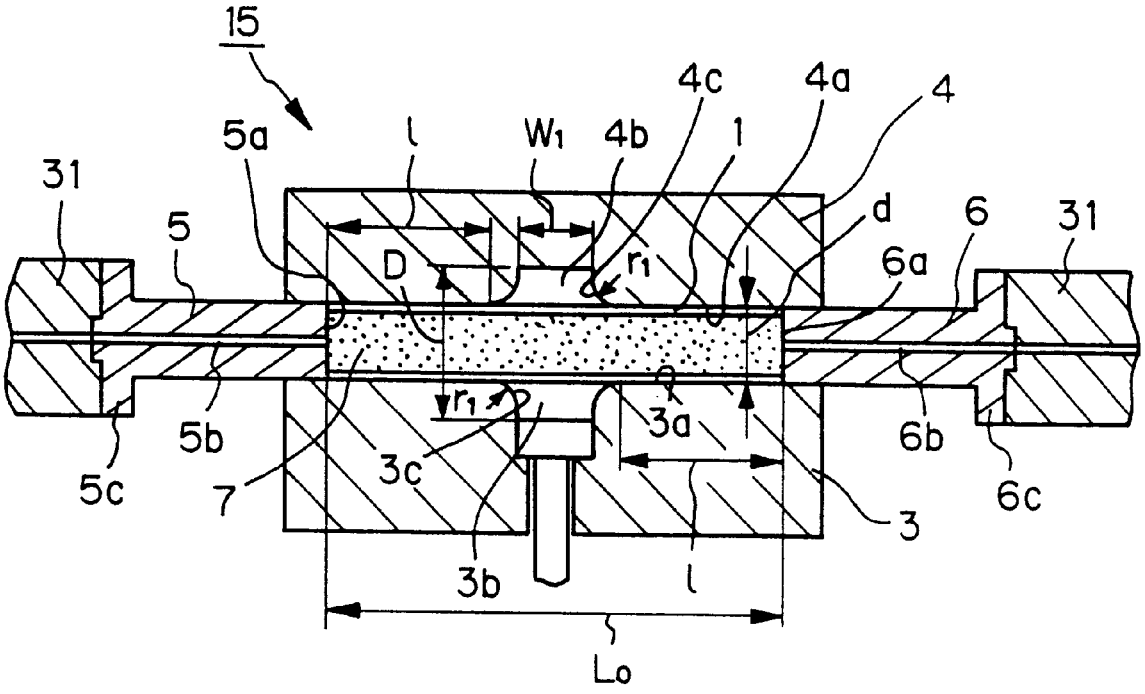
FIG. 7 is a longitudinal sectional view showing a state of hydroforming performed through the application of an internal pressure and axial forces to a metallic tube, wherein FIG. 7(*a*) is a longitudinal sectional view showing a state immediately before hydroforming is started and FIG. 7(*b*) is a longitudinal sectional view showing a state when hydroforming is completed.
Figure 7B:
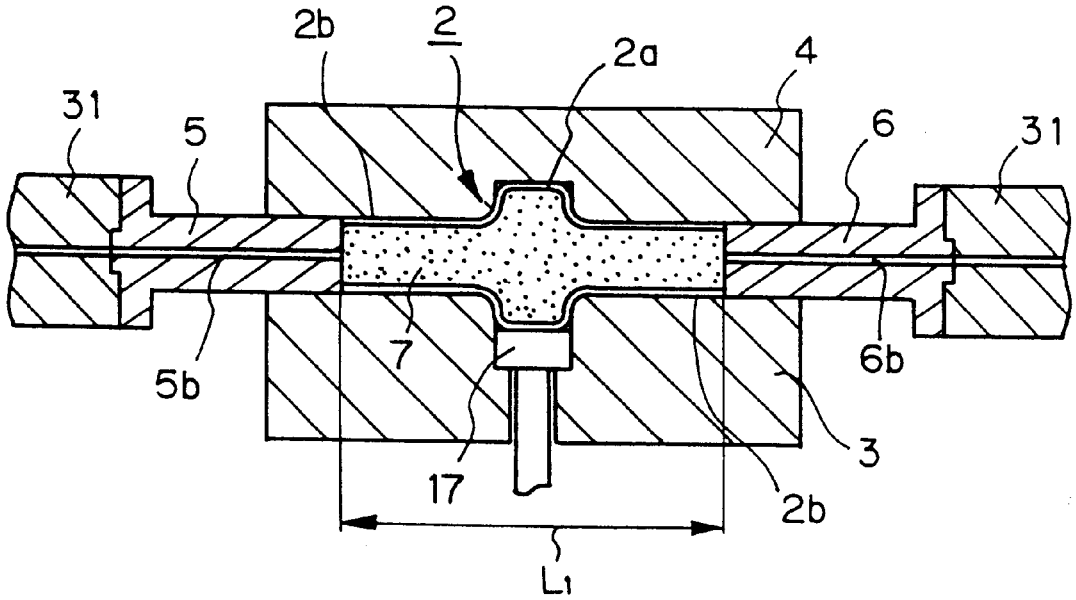

Since both end portions of the metallic tube 1 are held by the outer punches 83 and 84, the length Ld of the upper and lower holders 82 and 81 can be shorter than the length of the upper and lower dies 4 and 3 used in the conventional hydroforming process shown in FIG. 7, and may be slightly longer than the length $W_0$. In the conventional process shown in FIG. 7, the upper and lower dies must be clamped together with a force greater than a reaction force induced by the internal pressure acting over the entire length of the metallic tube 1. By contrast, in the method of the present invention, the internal pressure acting on the metallic tube inserted into the hollow cylindrical outer punches can be supported by the wall of hollow cylindrical outer punches, a force of clamping the upper and lower holders can be smaller than a force of clamping the upper and lower dies used in the conventional process. That is, in FIG. 8, the pressurizing capability of the upper pressure cylinder 27 can be decreased.

FIGS. 3(*b*) and 3(*c*) show a first step of hydroforming, i.e. a preliminary expansion step. In FIG. 3(*c*), a preliminary radially expanded portion "a" having a surface area substantially identical to that of the expanded portion 2*a* of a product is formed in the die cavity 200 having the length $W_0$.

There are two methods, method A and method B, for performing the preliminary expansion process.

According to method A, while both ends of the metallic tube 1 are sealed by the inner punches 85 and 86, the internal pressure of the metallic tube 1 is increased so as to preliminarily radially expand the metallic tube 1. The amount of preliminary expansion is determined to the such that accompanying wall thinning is acceptable for a concerned product. Under such a condition, the length $W_0$ is determined so as to obtain a required surface area of a preliminary radially expanded portion.

According to method B, the inner punches 85 and 86 are advanced so as to preliminarily radially expand the metallic tube 1 In this case, the internal pressure is limited to such a level that buckling does not occur at the preliminary expanded portion as a result of axial compression applied from the tube ends by the inner punches 85 and 86. The amount of advancement of the inner punches 85 and 86 is determined so that a required surface area of the preliminary expanded portion is obtained.

Since a material length l-1 within the outer punches 83 and 84 shown in FIG. 3(*b*) is shorter than a material length l within the die cavity shown in FIG. 7(*a*), resistance to axial pressing is smaller than that in the case of FIG. 7. Thus, the aforementioned buckling 8 and thick-walled portion 9 are less likely to occur.

The advantage of method A is that the metallic tube length can be relatively short, since the preliminary radially expanded portion is formed by means of the internal pressure. Thus, method A shows better material yield than method B. Since preliminary radial expansion is performed merely through use of the internal pressure, method A involves no fear of buckling and is suited for expansion of a thin-walled metallic tube. The advantage of method B is that wall thinning at the preliminary radially expanded portion is smaller than that in method A. Of course, methods A and B may be combined as needed. An internal pressure required for the preliminary expansion step depends on the strength of a metallic tube, work hardening, wall thickness, and the amount of expansion. Accordingly, the pressure of a hydraulic fluid contained in a metallic tube must be controllably independent of whether or not or how much the inner punches are moved. FIGS. 3(*c*) and 3(*d*) show a finishing step of forming, i.e. a step of compressing the preliminary radially expanded portion. In the state of FIG. 3(*c*), the inner punches 85 and 86 and the outer punches 83 and 84 are advanced. As a result, as shown in FIG. 3(*d*), there is obtained a product including the expanded portion 2*a* having a predetermined dimension and the straight portions 2*b*.

In such a compression step, the inner and outer punches are moved preferably at the same rate for the following three reasons. First, the expanded portion of a product is obtained without changing the surface area of the preliminary expanded portion. Second, since there can be a reduction of the axial compression force acting on the tube material contained in the outer punches, it reduces the fear of buckling at the end portions of a metallic tube. Third, through reduction of frictional sliding between the tube material and the inner surfaces of the outer punches, the formation of scratches on the tube surface can be reduced.

Figure 9A:
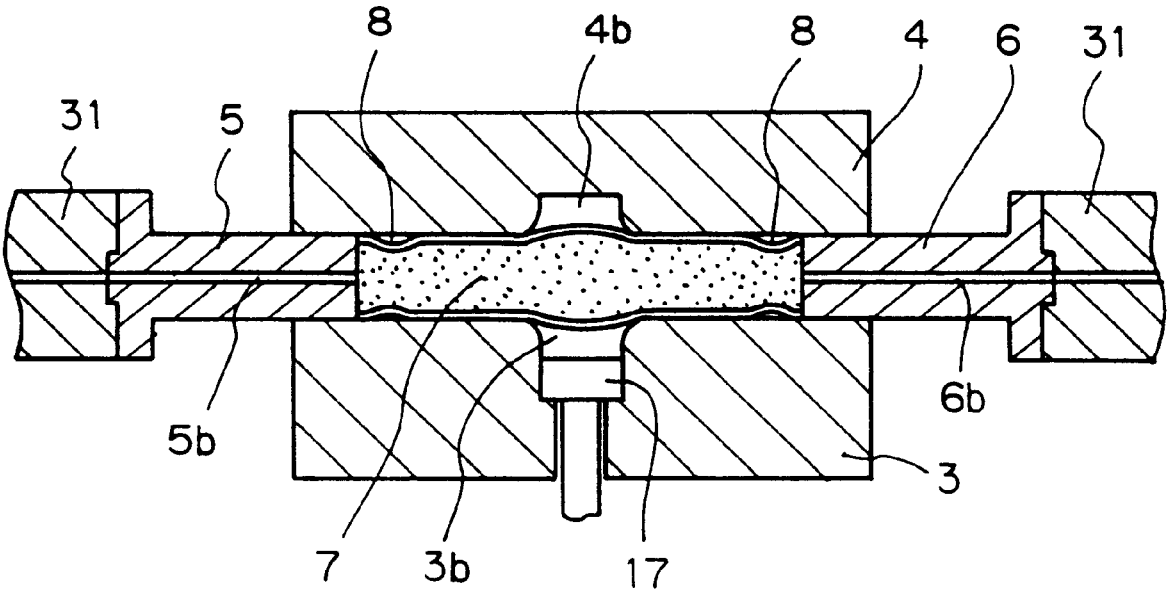
FIG. 9 is a longitudinal sectional view showing the occurrence of a defect during hydroforming, wherein FIG. 9(*a*) is a view showing the occurrence of buckling and FIG. 9(*b*) is a view showing the occurrence of wall thickening at tube end portions.
Figure 9B:
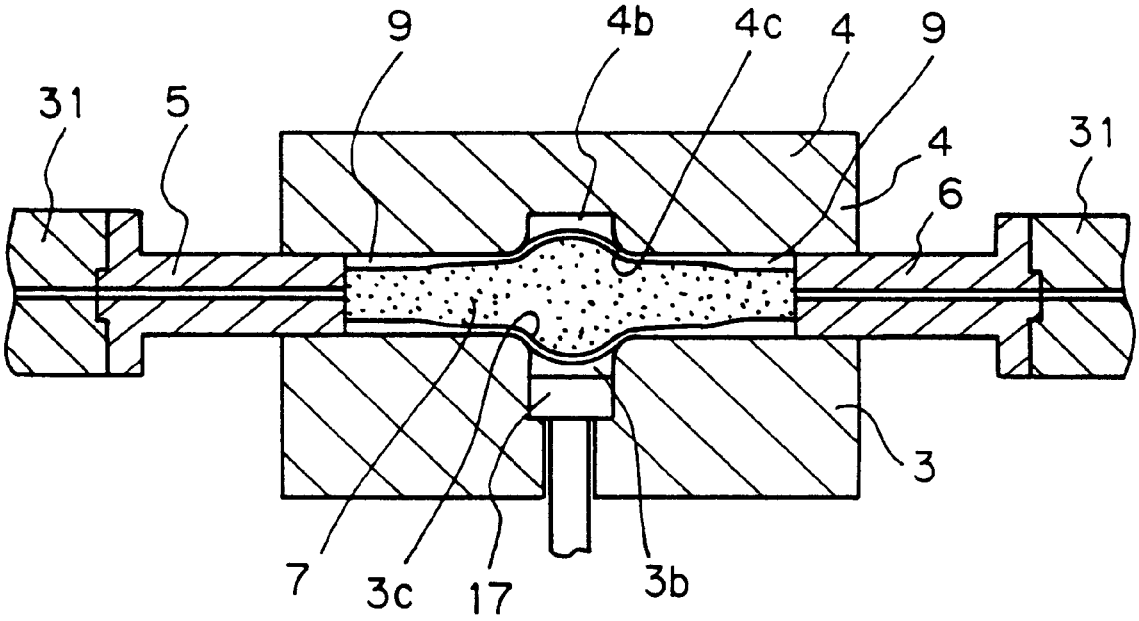

After the step of FIG. 3(*d*), the pressure of the hydraulic fluid 7 is decreased, the outer punches 83 and 84 are retreated, the upper holder 82 is raised, the inner punches 85 and 86 retreat causing the drainage of hydraulic fluid 7, and then the product 2 is removed from the lower holder 81. Since the retreat of the outer punches 83 and 84 serves as the ejection of the product 2, the ejector 17 illustrated in FIG. 9 is not required.

Figure 8A:
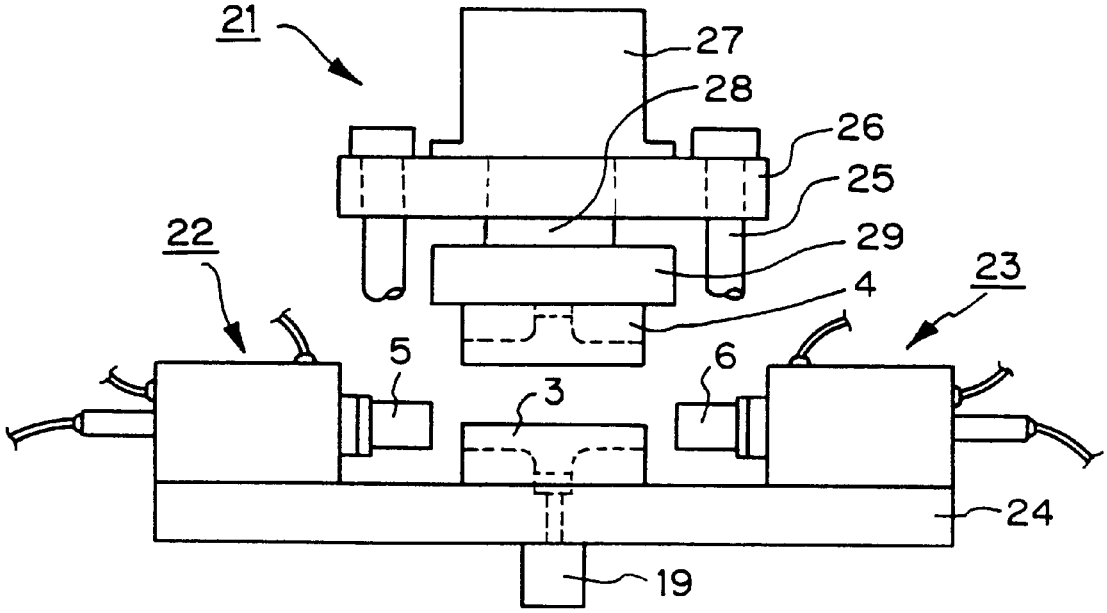
FIG. 8 is a view showing a conventional hydroforming apparatus, wherein FIG. 8(*a*) is a front view of the overall apparatus and FIG. 8(*b*) is a sectional view of a horizontal press unit.
Figure 8B:
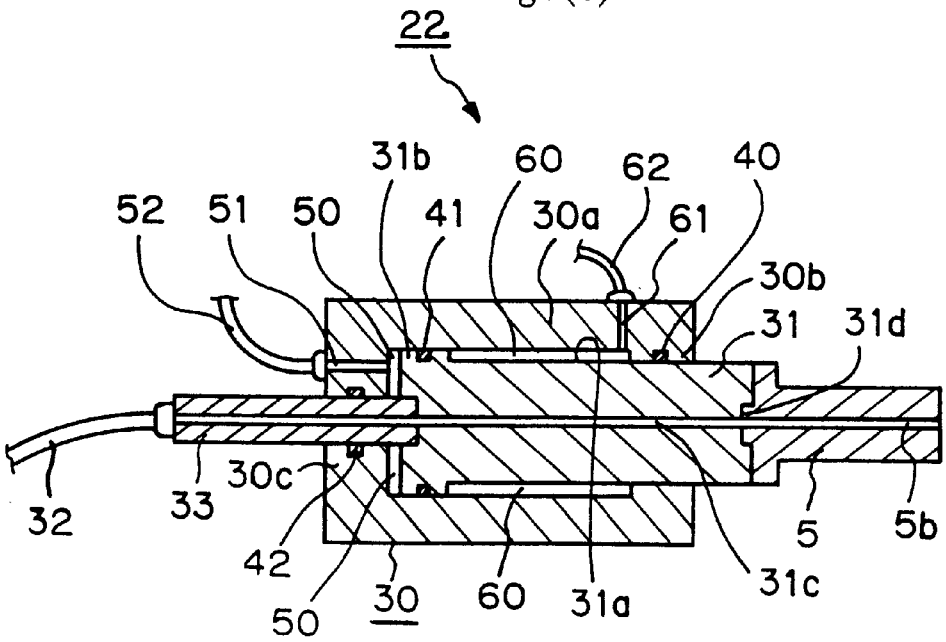
Figure 10A:
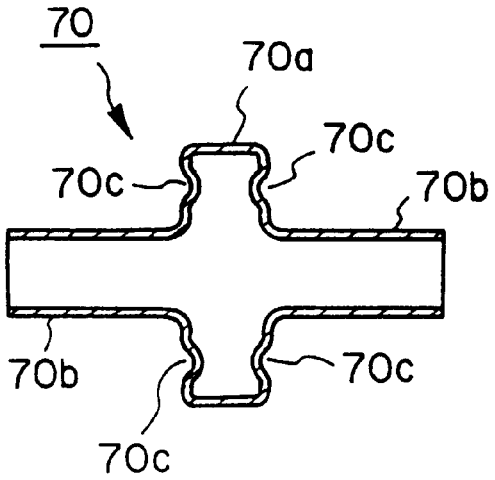
FIG. 10 is a view showing a tubular product having a rather complex shaped expanded portion, wherein FIG. 10(*a*) is a longitudinal sectional view of the product and FIG. 10(*b*) is a front view of the product.
Figure 10B:
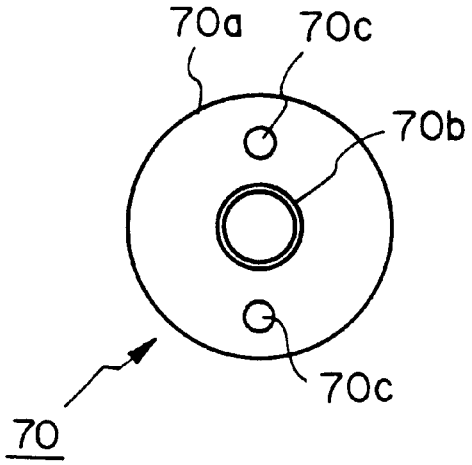
Figure 11:
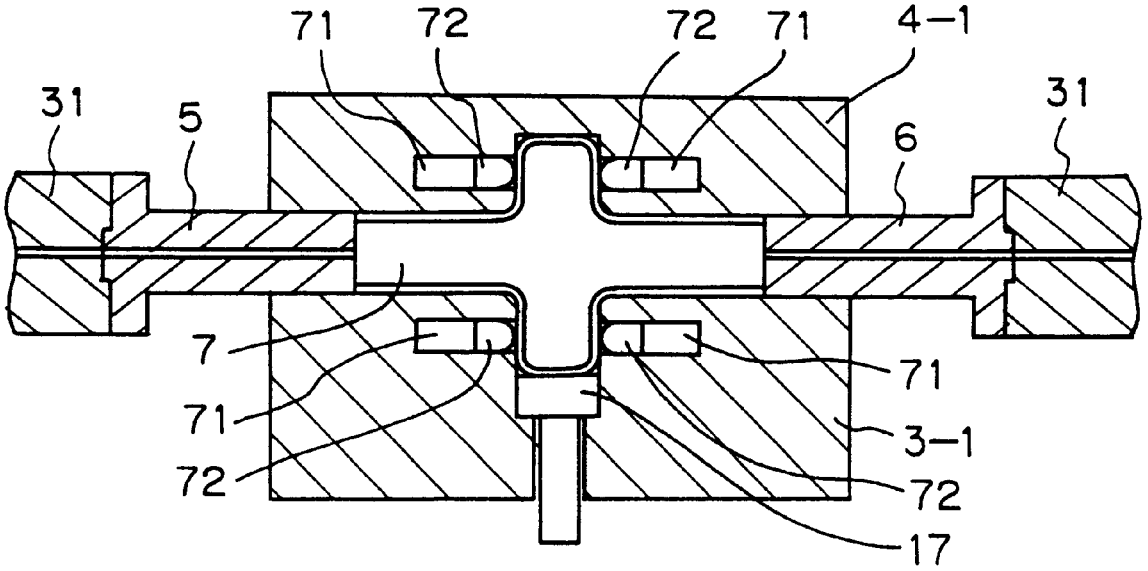
FIG. 11 is a longitudinal sectional view showing the structure of a conventional die for hydroforming.

FIG. 4 is a longitudinal sectional view showing the formation of the product of FIG. 10 having indentations formed in its expanded portion. As shown in FIG. 4, through use of the outer punches 83 and 84 having a tip projection 73, the product of FIG. 10 can be readily formed. Also, after the forming is completed, the product can be readily released by retreating the outer punches 83 and 84. The present invention is applicable to the formation of an expanded portion having any shape of side walls so long as the outer punches can be retreated The above-mentioned movements of the inner and outer punches are possible only when the double acting horizontal press unit having the inner and outer pistons as shown in FIG. 2 is used, and cannot be attained by the conventional horizontal press unit having a single piston as shown in FIG. 8(*b*).

EXAMPLES

EXAMPLE 1

The carbon steel tube for machine purposes, STKM12a (JIS G 3445), having the below dimensions was used as the metallic tube shown in FIG. 5(*a*) and hydroformed to the product of FIG. 5(*b*) having the below dimensions

[Metallic tube]

Outer diameter (d): 89.1 mm

Wall thickness (t): 2.0 mm

Length ($L_0$): 510 mm (weight: 2.2 kg)

[Product]

Outer diameter of expanded portion (D): 170 mm

Outer diameter of straight portion (d): 89.1 mm

Length of expanded portion ($W_1$): 100 mm

Root forming corner radius r ($r_1$): 20 mm

Top shoulder radius r ($r_2$): 10 mm

Overall length of tubular part ($L_1$): 340 mm

The product is required to have a minimum wall thickness of 1.5 mm for the expanded portion 2*a* and 20 mm for the straight portions 2*b*.

The hydroforming apparatus shown in FIGS. 1 and 2 was used. Major dimensions of the component parts are as follows:

Through hole diameter of punch holder (D): 170 mm

Length of through hole (tube holding grooves 81*a* and 82*a*) of punch holder (Ld): 300 mm Outer diameter of punch holders (82, 81): 89.1 mm Outer diameter (D) and bore diameter (d) of inner punches (85, 86): 170 mm (D), 89.1 mm(d)

Inner tip shoulder radius ($r_1$) of outer punches (83, 84): 20 mm

The inner piston 91 for horizontally moving the inner punch and the outer piton 92 for horizontally moving the outer punch (FIG. 2) had the following maximum axial force and stroke.

Maximum axial force: 50 tons

Maximum stroke: 150 mm

The above metallic tube was preliminarily expanded through use of the above apparatus in the steps of: positioning the outer punches such that the length $W_0$ of the preliminary expanded portion of FIG. 3(*b*) becomes 270 mm; bringing the inner punches in close contact with the metallic tube ends so as to seal the tube ends; clamping the upper and lower holders with a force of 50 tons; injecting the hydraulic emulsion into the metallic tube; and increasing the emulsion pressure to 200 bar so as to preliminarily expand the portion of the metallic tube present in the die cavity 200 to an outer diameter of approximately 103 mm.

The minimum wall thickness of the preliminary expanded portion was 1.7 mm. Subsequently, while the internal pressure was maintained at 200 bar, the inner and outer punches were advanced from the left- and right-hand sides at a rate of 20 mm/sec. Finally, the inner and outer punches were caused to stop moving when they reached the position corresponding to $L_1$=340 mm and $W_1$=100 mm as shown in FIG. 3(*d*). Thus, the product having the expanded portion having the above dimensions was obtained.

The top shoulder radius $r_2$ of the expanded portion 2*a* was 10 mm as targeted. The right- and left-hand inner pistons exhibited a maximum axial force of approximately 23 tons. The right- and left-hand outer pistons exhibited a maximum axial force of approximately 33 tons. The expanded portion of the product exhibited a minimum wall thickness of 1.7 mm, and the straight portions of the product exhibited a minimum wall thickness of 2.0 mm, thus satisfying the minimum wall thickness requirement For comparison, the carbon steel tube for machine purposes, STKM12a (JIS G 3445), having the below dimensions was used as a metallic tube and hydroformed according to the conventional method.

The wall thickness of the metallic tube was thicker than that of the above example of the present invention, since buckling will occur if the wall thickness of the above example is employed.

[Metallic tube]

Outer diameter (d): 89.1 mm

Wall thickness (t): 3.2 mm

Length ($L_0$): 550 mm (weight: 3.7 kg)

Figure 6B:
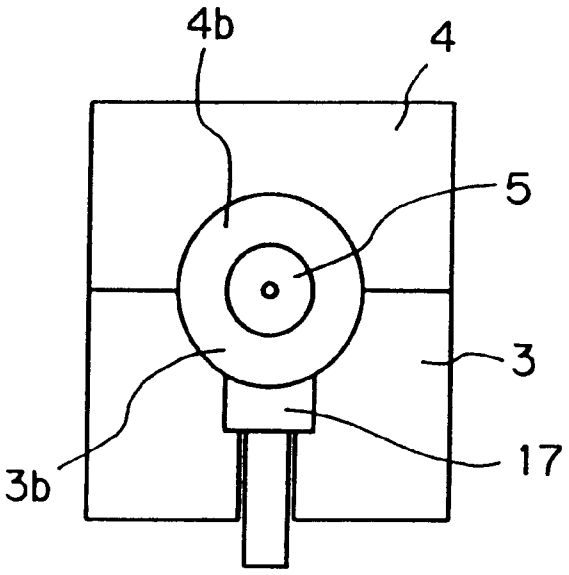
FIG. 6 is a view showing a typical conventional tool for hydroforming, wherein FIG. 6(*a*) is a longitudinal sectional view and FIG. 6(*b*) is a sectional view taken along the line C—C in FIG. 6(*a*)
Figure 6A:
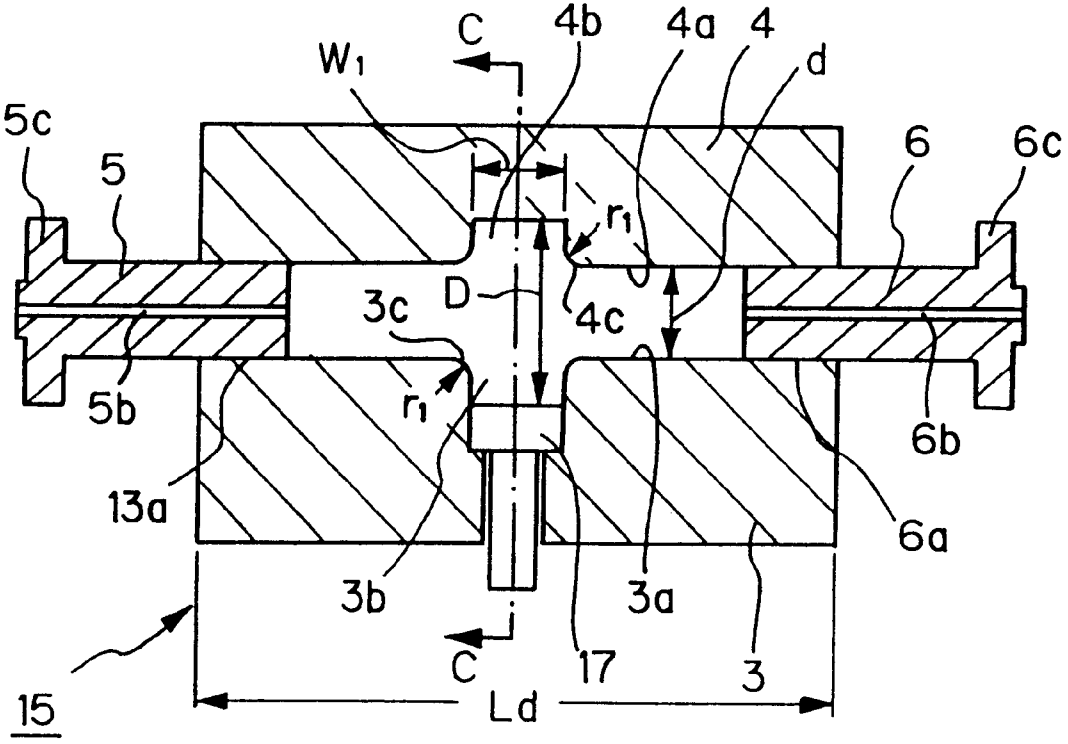

The employed hydroforming apparatus included the component parts shown in FIG. 6 and the horizontal press unit shown in FIG. 8(*b*). Major dimensions of the component parts are as follows.

Diameter (d) of tube holding grooves (3*a*, 4*a*): 89.1 mm

Die cavities (3*b*, 4*b*)
- Diameter (D): 170 mm
- Length ($W_1$): 100 mm
- Shoulder radius ($r_1$): 20 mm Upper and lower dies (4, 3)
- Length (Ld): 600 mm The piston 31 of the horizontal press unit had a maximum axial force of 150 tons and a maximum stroke of 150 mm.

The above metallic tube underwent hydroforming through use of the above apparatus in the steps of: setting the metallic tube as shown in FIG. 7(*a*); sealing the metallic tube ends by means of the punches 5 and 6 having an outer diameter d of 89.1 mm and attached to the corresponding horizontal press units (22 and 23 in FIG. 8); clamping the upper and lower dies with a force of 700 tons by means of the pressure cylinder 27; injecting the hydraulic emulsion 7 into the metallic tube; advancing the punches 5 and 6 from the left- and right-hand sides at a rate of 20 mm/sec and at the same time, increasing the internal pressure gradually so as to expand the tube material into the die cavities; and stopping the punches 5 and 6 when they reached the position corresponding to $L_1$=340 mm as shown in FIG. 7(*b*). Thus, there was obtained the product having the expanded portion 2*a* having an outer diameter D of 170 mm and a length $W_1$, of 100 mm.

The expanded portion of the product exhibited a minimum wall thickness of 2.6 mm. An internal pressure of 2,000 bar was required in order for the finish top shoulder radius r2 of the expanded portion to meet a target of 10 mm. The pistons 31 of the right- and left-hand horizontal press units were required to produce a maximum axial force of 125 tons.

As seen from the above test results, through use of the hydroforming method and apparatus of the present invention, the weight of a metallic tube used as material can be reduced by about 40%. The maximum internal pressure can be reduced by a factor of 10, and the die clamping force can be reduced by a factor of 14. Thus, the required capability of the hydroforming apparatus can be decreased.

EXAMPLE 2

The carbon steel tube for machine purposes, STKM12a (JIS G 3445), having the below dimensions was used as the metallic tube shown in FIG. 5(*a*) and hydroformed to the product having the same dimensions as those of Example 1.

[Metallic tube]

Outer diameter (d): 89.1 mm

Wall thickness (t): 2.0 mm

Length ($L_0$): 510 mm (weight: 3.1 kg)

The employed hydroforming apparatus was the same as that of Example 1.

The above metallic tube was preliminarily expanded in the steps of: positioning the outer punches such that the length $W_0$ of the preliminary expanded portion in FIG. 3(*b*) becomes 270 mm; sealing the metallic tube ends by means of the inner punches; clamping the upper and lower holders with a force of 75 tons; injecting the hydraulic emulsion into the metallic tube; and increasing the emulsion pressure gradually to 300 bar and at the same time, advancing the inner punches in an amount of 20 mm so as to preliminarily expand the portion of the metallic tube present in the die cavity 200 to an outer diameter of approximately 103 mm. The minimum wall thickness of the preliminary expanded portion was 2.4 mm.

Subsequently, while the internal pressure was maintained at 300 bar, the inner and outer punches were advanced from the left- and right-hand sides at a rate of 20 mm/sec. Finally, the inner and outer punches were caused to stop moving when they reached the position corresponding to $L_1$=340 mm and $W_1$=100 mm as shown in FIG. 3(*d*). Thus, there was obtained the product having the expanded portion 2*a* having an outer diameter D of 170 mm and a length $W_1$ of 100 mm.

The top shoulder radius $r_2$ of the expanded portion 2*a* was 10 mm as targeted. The right- and left-hand inner pistons exhibited a maximum axial force of approximately 32 tons. The right- and left-hand outer pistons exhibited a maximum axial force of approximately 50 tons. The expanded portion 2*a* of the product exhibited a minimum wall thickness of 2.4 mm, thus satisfying the minimum wall thickness requirement for the product. The straight portions of the product exhibited a thickness ranging from 2.6 mm to 2.8 mm, thus satisfying a required tolerance.

For comparison, the metallic tube of the same material and dimensions as those of Example 1 was hydroformed to the tubular part under the same forming conditions as those of the conventional method of Example 1 through use of the same hydroforming apparatus as that used in the conventional method of Example 1 except that the length of the upper and lower dies was 570 mm.

The expanded portion of the product exhibited a minimum wall thickness of 2.6 mm. An internal pressure of 2,000 bar was required in order for the finish top shoulder radius r2 of the expanded portion to meet a target of 10 mm. The pistons 31 of the right- and left-hand horizontal press units were required to produce a maximum axial force of 125 tons. The wall thickness of the straight portions 2*b* of the product fell in the range of 3.5 mm to 4.0 mm. Since this range fails to satisfy a required tolerance of the product, the straight portions 2*b* had to be finished through machining As seen from the above test results, through use of the hydroforming method and apparatus of the present invention, the weight of a metallic tube used as material can be reduced by about 18%. The straight portions of the product does not require additional finish machining. The maximum internal pressure can be reduced by a factor of 6 to 7, and the die clamping force can be reduced by a factor of approximately 9. Thus, the required capability of the hydroforming apparatus can be decreased.

The hydroforming method and apparatus of the present invention produces the following five effects.

First, the frictional force between a material and a tool decreases as compared to the conventional method. As a result, the occurrence of buckling during axial pressing is suppressed; thus, a thin-walled tube can be readily hydroformed. In the case of a thick-walled tube, since wall thickening at the straight portions of a product is suppressed, material yield improves, and finish machining becomes unnecessary. Also, there is significantly decreased the occurrence of seizure between the material surface and a tool which would otherwise be induced from sliding therebetween. Thus, any lubrication is not necessary for a metallic tube used as material, and tool maintenance is facilitated.

Second, through the employment of preliminary expansion, after the preliminary expansion step is completed, the preliminary expanded portion is held between the tip end portions of the outer punches and thus can be axially compressed in a reliable manner. That is, axial compression forces act effectively on the preliminary expanded portion before main axial pressing is started. Thus, the circumferential length of the expanded portion can be increased efficiently.

Third, a required internal pressure is decreased. Specifically, as compared with the conventional method illustrated in FIG. 8 in which a tube material is expanded along the die cavity whose volume is fixed, preliminary expansion can be performed at a lower internal pressure in the preliminary step where a space equivalent to the die cavity has a larger volume. Also, in the subsequent axial compression step, the expanded portion of a product is formed by means of the outer punches; thus, the internal pressure can be lower than that of the conventional method.

A reduction of the internal pressure retards wall thinning of the expanded portion; thus, a thinner-walled metallic tube can be hydroformed. Further, there is no need for using a superhigh-pressure hydraulic fluid pump, which is expensive and involves high maintenance cost. Accordingly, equipment cost can be reduced.

Fourth, die cost is reduced. As mentioned previously, through use of the outer punches, the length of the upper and lower dies can be decreased. Accordingly, die-manufacturing cost is reduced. Since the outer punches can be used in common among dies used for forming products from metallic tubes having the same diameter, the employment of the outer punches is economical. Also, since a die cavity used for forming the expanded portion of a product is defined by the holder and the right- and left-hand outer punches, there is no need for machining a die cavity as in the case of the conventional die shown in FIG. 7. Accordingly, die-manufacturing cost is reduced.

Fifth, even the product 70 having indentations 70*c* formed in the side walls of the expanded portion as shown in FIG. 10 can be formed readily through use of the outer punches 83 and 84 whose tip portions each have the projection 73 as shown in FIG. 4. After forming is completed, the outer punches are retreated; thus, the product can be removed without any difficulty.

As described above, through use of the hydroforming method and apparatus of the present invention, the occurrence of buckling is suppressed during axial compression of a metallic tube. Accordingly, a thinner-walled product can be manufactured as compared to the conventional method. Also, since the pressure of a hydraulic fluid can be decreased, wall thinning of an expanded portion can be retarded. That is, since a thinner-walled metallic tube can be used as material as compared to the conventional method, material yield is improved, and material cost can be reduced. Further, there can be omitted finish machining for the bore diameter of the straight portions of a product. Additionally, since sliding between a material and a tool decreases, tool maintenance cost is reduced. Advantageous aspects of equipment include a reduction in the clamping force of the upper pressure cylinder of the hydroforming apparatus, a reduction in the maximum pressure of the hydraulic fluid pump, and a reduction in die cost. Thus, the present invention significantly contributes to cost reduction in tube hydroforming.

What is claimed is:

1. A method for hydroforming a metallic tube in which part of the metallic tube is expanded through combined use of an internal pressure imposed by a fluid contained in the metallic tube and an axial compression of the metallic tube, comprising the steps of: preliminarily expanding the metallic tube over an axial section longer than the length of the expanded portion of a final product as measured in the axial direction of the metallic tube by a fluid pressure applied to the interior of the metallic tube, and a compressive force applied in the axial direction of the tube, thereby causing the tube material in the portion other than the portion to be preliminarily expanded to flow into the preliminary expanded portion; and compressing the preliminarily expanded portion in the axial direction of the metallic tube so as to form the shape of the expanded portion of the final product.

2. The method according to claim 1, wherein a compressive force in the axial direction of the tube is applied to the expanded portion formed through preliminary expanding, and simultaneously, a compressive force in the axial direction of the tube is applied to the metallic tube at each end thereof, to thereby cause a compression processing so that the compression rate within the expanded portion in the axial direction of the metallic tube is equal to the compression rate of the compression applied at each end of the metallic tube.

3. An apparatus for hydroforming a metallic tube, comprising: a split-type punch holder having a through hole; a pair of hollow cylindrical outer punches inserted slidably into the through hole from both ends of the through hole; and a pair of inner punches inserted slidably into the corresponding outer punches so as to axially compress the metallic tube inserted into the outer punches from both ends of the metallic tube; wherein a hydraulic fluid path is formed in the inner punches and wherein a pair of punch advancing-retreating means is provided for advancing or retreating the inner punch and the outer punch independently of each other in the axial direction of the metallic tube.

4. The apparatus according to claim 3, wherein the punch advancing-retreating means comprises an inner piston for advancing or retreating the inner punch in the axial direction of the metallic tube and a cylindrical outer piston for advancing or retreating the outer punch in the axial direction of the metallic tube, the inner piston is placed within the cylindrical outer piston, and a hydraulic fluid path is formed in the inner piston in a manner connectable to the hydraulic fluid path formed in the inner punch.

* * * * *